US005103528A

United States Patent [19]

Olson et al.

[11] Patent Number: 5,103,528

[45] Date of Patent: Apr. 14, 1992

[54] REFRIGERATION, FOAM SEALING BUSHING

[75] Inventors: William J. Olson, Barrington; James S. Zielinski, Roselle; Michael C. Blaha, Chicago, all of Ill.

[73] Assignee: Illinois Tool Works Inc., Glenview, Ill.

[21] Appl. No.: 654,295

[22] Filed: Feb. 12, 1991

[51] Int. Cl.[5] ..... B65D 55/00

[52] U.S. Cl. ..... 16/2

[58] Field of Search ..... 16/2, 108

[56] References Cited

U.S. PATENT DOCUMENTS

| | | | |
|---|---|---|---|
| 2,592,130 | 4/1952 | Erb et al. | 16/2 |
| 3,091,795 | 6/1963 | Budwig . | |
| 3,665,548 | 5/1972 | Mason . | |
| 3,725,973 | 4/1973 | Gwozdz . | |
| 3,843,833 | 10/1974 | Nicholson | 16/2 |
| 3,887,960 | 6/1975 | Sherman . | |
| 4,089,496 | 5/1978 | Mizusawa . | |
| 4,180,297 | 12/1979 | Abrams . | |
| 4,186,945 | 2/1980 | Hahn . | |
| 4,656,689 | 4/1987 | Dennis | 16/2 |
| 4,883,319 | 11/1989 | Scott . | |

*Primary Examiner*—Robert L. Spruill
*Assistant Examiner*—Carmine Cuda
*Attorney, Agent, or Firm*—Schwartz & Weinrieb

[57] ABSTRACT

A refrigration, foam sealing bushing is provided for use within a refrigeration door cavity. The bushing is formed of a male member, and a female member. The male member includes a head portion, an upper shank portion, a reduced lower shank portion, and a disc-like member. The female member is formed of a tubular section having an open upper end and an open lower end. The tubular section has an axially extending bore which extends between the open upper end and the open lower end for telescopingly receiving the lower shank portion of the male member. Passageways are formed between the outer surface of the reduced lower shank portion and inner surface of the axially extending bore of the tubular section for permitting air to escape from the door cavity but yet preventing foam insulation from escaping during the injection of the foam insulation into the door cavity.

20 Claims, 2 Drawing Sheets

REFRIGERATION, FOAM SEALING BUSHING

BACKGROUND OF THE INVENTION

1. Field of the Invention

This invention relates generally to bushing assemblies and more particularly, it relates to a foam sealing bushing for use within a refrigerator door cavity which permits air to escape from the door cavity but yet prevents foam insulation from escaping during the injection of the foam insulation into the door cavity.

2. Description of the Prior Art

As is generally known in the refrigeration art, a refrigerator door is hingedly mounted upon a refrigerator cabinet for closing the opening to the refrigeration compartment define within the refrigerator cabinet. In accordance with prior art manufacturing techniques, the refrigerator door usually comprises a door cavity which is filled with foamed-in-place insulation. Since the door is to be hingedly mounted upon the cabinet, this necessitates that an opening be cut within the door and the foam insulation so as to accommodate a bushing assembly after the insulation was formed in place and allowed to rigidify.

Accordingly, it would be desirable to provide a bushing which can be installed within the refrigerator door cavity prior to the foaming operation so as to eliminate the need for cutting an opening within the foam insulation after it has rigidified. However, during the foaming operation, it has been known that relatively high air pressures are produced. Thus, there has arisen a need for a bushing which can be installed within a refrigerator door cavity prior to the foaming insulation operation and which provides a passageway so as to allow the highly pressurized air to escape from the door cavity but yet still prevents the flow of the foam insulation outwardly therefrom.

A prior art search directed toward the subject matter of this application and conducted in the U.S. Patent and Trademark Office revealed the following U.S. Pat. Nos.:

| | |
|---|---|
| 2,592,130 | 4,089,496 |
| 3,091,795 | 4,180,297 |
| 3,665,548 | 4,186,945 |
| 3,725,973 | 4,656,689 |
| 3,887,960 | 4,883,319 |

In U.S. Pat. No. 2,592,130 to George H. Erb et al., issued on Apr. 8, 1952, there is disclosed an insulating fastening device comprised of an outer hollow member and a cooperating inner member. The outer member includes a head portion and a shank portion having latching abutments. The inner member is provided with external abutments for fixed engagement with the latching abutments upon the outer member. In U.S. Pat. No. 3,887,960 to George R. Sherman issued on June 10, 1975, there is disclosed a shaft bushing comprising a thin washer and a spool-like member having a tubular portion with a flange at one end and a split tapered formation at the other end. The tubular portion has a bore which is adapted to slip closely over the shaft. The tapered formation is adapted to be compressed and snapped through the washer bore so as to provide an interlocking engagement.

U.S. Pat. No. 4,656,689 to Frank S. Dennis issued on Apr. 14, 1987, teaches a grommet device which is made up of a fastener portion and a seal portion. The fastener portion includes a plurality of projections with locking tabs at the ends. The seal portion has a plurality of openings positioned so as to receive the projections when the grommet device is assembled. The locking tabs engage a wall portion of a wall opening disposed behind the seal portion so as to secure the grommet device in place.

U.S. Pat. No. 4,883,319 to Glenn Scott issued on Nov. 28, 1989, teaches a self-locking spacer bushing assembly for use within a hinge for an automotive vehicle seat assembly. The bushing assembly includes a pair of identical interlocking sleeves, each having a pair of opposed tangs extending in an axial direction from an annular portion. Each of the tang portions has a shoulder which is radially outwardly directed and is deflectable. The shoulders upon the tang portions engage corresponding recessed ledges define upon the interior wall of the annular portion of the opposite sleeve so as to snap fit together thereby form an integral bushing assembly through which a hinge pin is passed.

The remaining patents listed above but not specifically discussed are deemed to be of only general interest and are cited to show the state of the art in bushing assemblies and/or grommet devices.

None of the prior art uncovered in the search disclosed a foam sealing bushing formed of a male member and a female member such as those of the present invention for use within a refrigerator door cavity which permits air to escape from the door cavity but yet prevents foam insulation from escaping during the injection of the foam insulation into the door cavity. This is accomplished by the provision of passageways formed between the male member and the female member for permitting air to escape from the door cavity.

OBJECTS OF THE INVENTION

Accordingly, it is a general object of the present invention to provide an improved foam sealing bushing used within a refrigerator door cavity which is relatively simple and economical to manufacture.

It is an object of the present invention to provide an improved foam sealing bushing which may be formed of a resilient plastic material by means of an injection molding process.

It is another object of the present invention to provide an improved foam sealing bushing for use within a refrigerator door cavity which permits air to escape from the door cavity but yet prevents foam insulation from escaping during the injection of the foam insulation into the door cavity.

It is still another object of the present invention to provide an improved foam sealing bushing formed of a male member, and a female member telescopingly receiving the male member and passageways means formed between the male member and female member for permitting the passage of air therethrough.

SUMMARY OF THE INVENTION

In accordance with the foregoing aims and objectives, the present invention is concerned with the provision of an improved foam sealing bushing for use within a refrigerator door cavity. The foam sealing bushing includes a male member and a female member. The male member includes a head portion, an upper shank portion, and a reduced lower shank portion and a disc-like member. The head portion is formed with an upper surface and a lower surface and has a central opening.

The upper shank portion extends axially between an upper end adjacent to the lower surface of the head portion and a lower end. The upper shank portion has an element-receiving bore which is in communication with the central opening define within the head portion.

The reduced lower shank portion extends axially between the lower end of the upper shank portion and an open end and has a circular bore which is coaxially aligned for communication with the element-receiving bore of the upper shank portion. The lower shank portion has a first pair of diametrically opposed ridge members formed upon its outer surface and extends axially from the lower end of the upper shank portion to a predetermined distance below its open end. Each of the first ridge members is provided with a locking tab. The lower shank portion further includes a second pair of diametrically opposed ridge members formed upon its outer surface and extends axially from the lower end of the upper shank portion to the same predetermined distance below its open end. The second pair of ridge members is disposed within a plane which is perpendicular to a plane within which the first pair of ridge members is disposed. The disc-like member is formed integrally with portions of the first and second ridge members adjacent to the open end of the lower shank portion so as to provide slots therebetween. Spacer legs are formed integrally with portions of the first and second ridge members adjacent to the lower end of the upper shank portion.

The female member is formed as a tubular section which has an open upper end and an open lower end. The tubular section has an axially extending bore which extends between the open upper end and the open lower end for telescopingly receiving the lower shank portion of the male member. The tubular section includes a pair of diametrically opposed windows for receiving the locking tabs defined upon the first ridge members of the male member so as to interlockingly engage the male and female members together. There are passageways formed between the adjacent spacer legs which separate the lower end of the upper shank portion of the male member from the open end of the tubular section and between the adjacent first and second ridge members which allows fluid communication with the element-receiving bore defined within the upper shank portion by means of the slots adjacent to the open end of the lower shank portion. As a result, the passageways permit air to escape from the door cavity but yet prevent foam insulation from escaping during the injection of the foam insulation into the door cavity.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, and wherein.

DESCRIPTION OF THE PREFERRED EMBODIMENT

Figure 14:
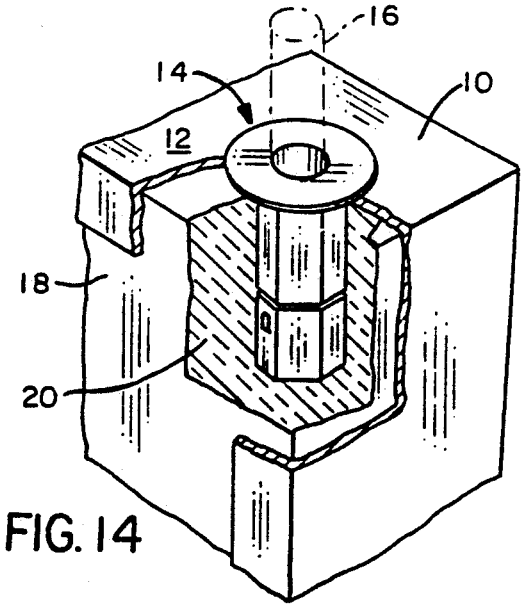
FIG. 14 is a fragmentary, perspective view of a refrigerator door cavity with portions broken away, illustrating the use of the bushing of the present invention.

Referring now in detail to the various views of the drawings and in particular to FIG. 14, there is illustrated a fragmentary, perspective view of a refrigerator door 10, that is partly broken away, having a top surface 12 and within which is received a foam sealing bushing 14 constructed in accordance with the principles of the present invention. The refrigerator door 10 is adapted to be hingedly mounted upon a refrigerator cabinet (not shown) by means of the use of the bushing 14 which receives a hinge pin 16 or the like. The bushing 14 of the present invention is positioned within the top surface 12 of the door and extends into the door cavity 18 prior to the foaming of foamed-in-place refrigeration insulation 20. As a result, there has been eliminated the need for an attendant cost of cutting an opening within the insulation foam after it has been rigidified.

As is known in the art of refrigerator assemblies, there exists relatively high air pressures which are used to produce the foaming operation. The bushing of the present invention has been constructed with passageways or openings so as to effectively allow the highly pressurized air to escape from the door cavity 18 during the injection of the insulation foam 20 into the cavity but yet prevents the insulation foam from escaping.

Figure 1:
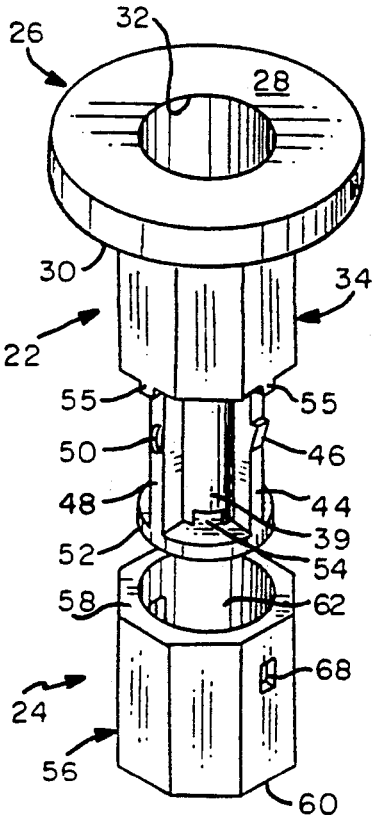
FIG. 1 is a perspective view of the foam sealing bushing constructed in accordance with the principles of the present invention, with the male and female members of the bushing shown in a separated, unassembled condition.
Figure 8:
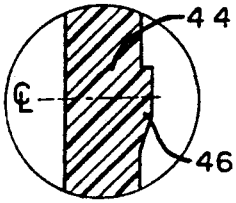
FIG. 8 is an enlarged view of the encircled area X of FIG. 4.
Figure 9:
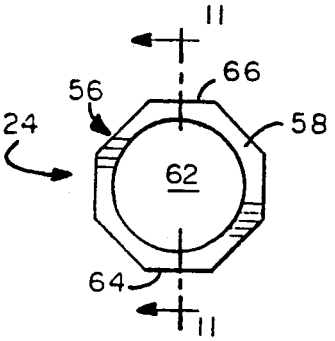
FIG. 9 is a top plan view of the female member of the bushing.
Figure 10:
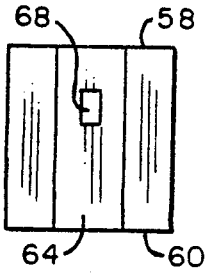
FIG. 10 is a front elevational view of the female member of FIG. 9.
Figure 11:
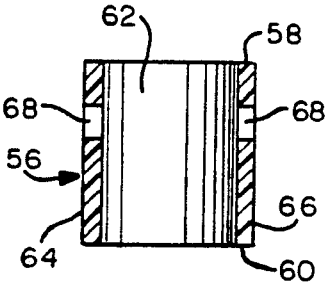
FIG. 11 is a cross-sectional view, taken along the lines 11—11 of FIG. 9.
Figure 12:
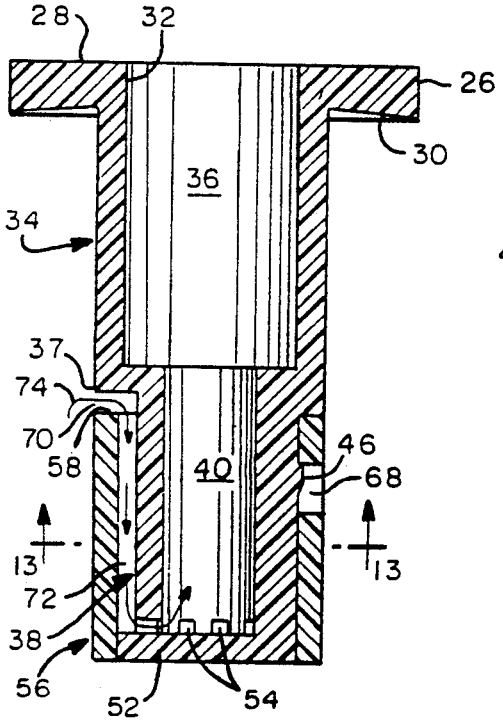
FIG. 12 is a vertical sectionalized side view, illustrating the male and female members of the bushing in the assembled condition.
Figure 13:
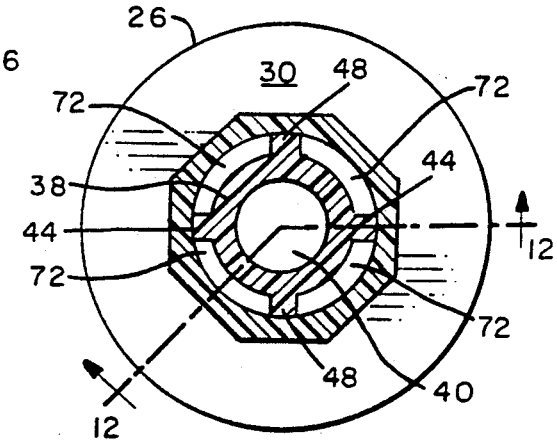
FIG. 13 is a cross-sectional view, taken along the lines 12—12 of FIG. 12.

The foam sealing bushing 14 of the present invention, as illustrated in FIG. 1, is comprised of a male member 22 (FIGS. 2–8) and a female member 24 (FIGS. 9–11). The male and female members 22–24 are preferably formed of a thermoplastic material such as, for example, nylon and the like having a suitable degree of elasticity by means of a conventional process such as, for example, automatic injection molding. After being formed as shown in FIG. 1, the female member is pushed upwardly towards the male member so as to telescopingly receive within its interior the male member and thereafter becomes interlockingly engaged therewith as illustrated in FIG. 12 and 13.

Referring now specifically to FIGS. 2 through 8 of the drawings, the male member 22 has a flange or head portion 26 which is of a generally flat, circular shape. However, it should be apparent to those skilled in the art that the head portion 26 may be rectangular, square, or any other shape rather than the round shape shown in the drawings. The head portion 26 has a flat upper surface 28 and a flat lower surface 30. The head portion 26 also has a central opening 32.

Figure 2:
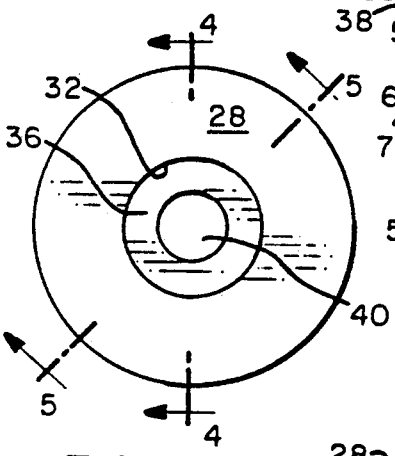
FIG. 2 is a top plan view of the male member of the bushing.

The male member 22 has a non-cylindrical or polygonal upper shank portion 34 which may be octagonal in cross-section, for example, and which has a circular-receiving bore 36 coaxially aligned for communication with the central opening 32. The upper end of the upper shank portion 34 is joined to the lower surface 30 of the head portion 26 and the upper shank portion 34 extends axially and downwardly therefrom to a lower end 37. A cylindrically-shaped, reduced lower shank portion 38 extends axially and downwardly from the lower end 37 of the upper shank portion 34. The lower shank portion 38 includes a circular bore 40 which is coaxially aligned for communication with the bore 36 and extends axially between the lower end of the upper shank portion 34 and an open end 42 of the lower shank portion, as best seen in FIG. 2. The upper shank portion 34 being octagonally shaped is installed within a similarly shaped aperture (not shown) defined within the top surface 12 of the refrigerator door 10 (FIG. 14) so as to prevent relative rotation thereof during use.

Figure 3:
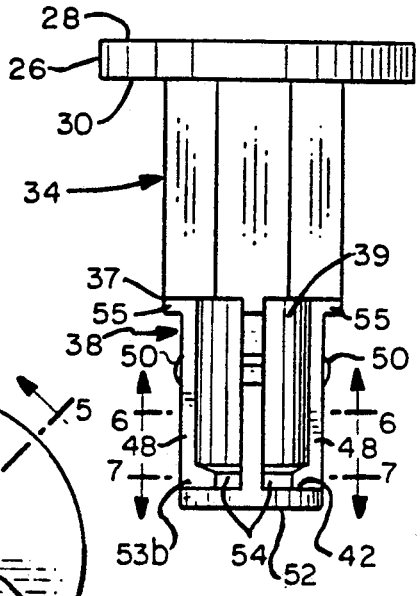
FIG. 3 is a side elevational view of the male member of the bushing of FIG. 1.
Figure 4:
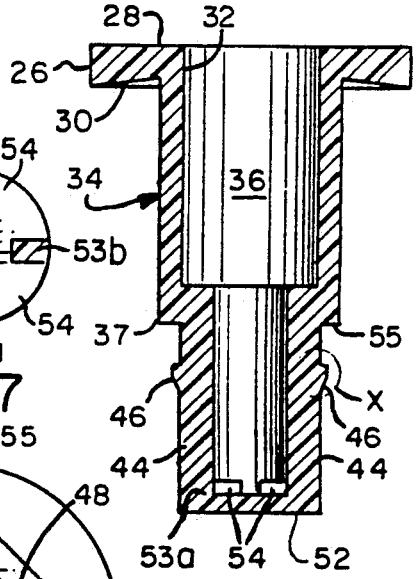
FIG. 4 is a cross-sectional view, taken along the lines 4—4 of FIG. 2.
Figure 7:
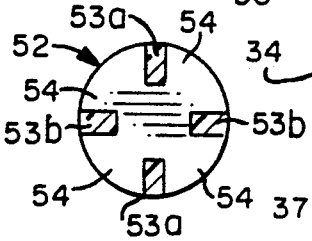
FIG. 7 is a cross-sectional view, taken along the lines 7—7 of FIG. 3.
Figure 5:
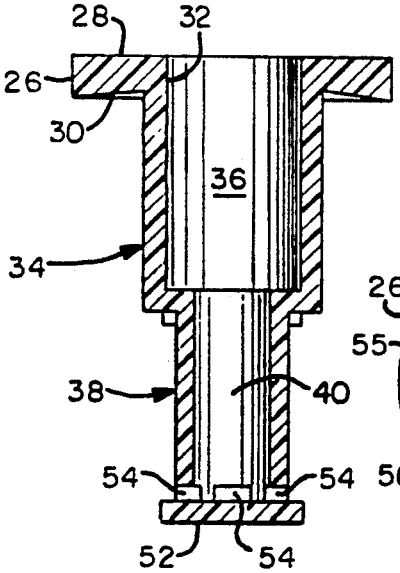
FIG. 5 is a cross-sectional view, taken along the lines 5—5 of FIG. 2.
Figure 6:
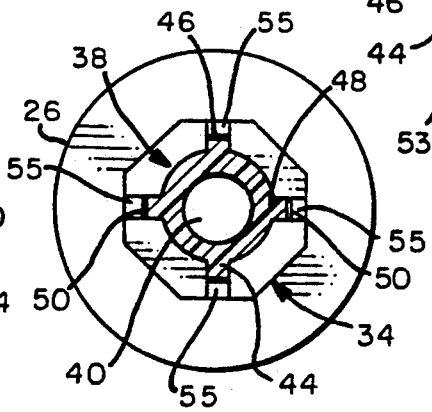
FIG. 6 is a cross-sectional view, taken along the lines 6—6 of FIG. 3.

On the outer surface 39 of the lower shank portion 38, as best seen in FIG. 3, there are integrally formed a pair of diametrically opposed ridge members 44 (FIG. 4) which extend axially from the lower end 37 of the upper shank portion to a predetermined distance toward the open end 42. In substantially the intermediate area of each ridge member 44, there is provided an outwardly extending step or locking tab 46 (FIG. 8). Furthermore, the lower shank portion 38 includes diametrically opposed ridge members 48 (FIG. 3) which are disposed within a plane which is disposed perpendicular to a plane within which the ridge members 44 are disposed and wherein member 44 also extend axially from the lower end 37 of the upper shank portion to the same predetermined distance at the open end 42. In substantially the intermediate area of each ridge member 48, there is provided a projection or bump 50. Thus, the ridge members 44 and 48 are disposed around the outer surface 39 of the lower shank portion 38 at 90° intervals.

A disc-like member 52 is formed integrally wi&:h the lower end portions 53*a*, 53*b* of the respective ridge members 44 and 48 adjacent the open end 42 so as to define four equally-spaced slots or openings 54 therebetween. The upper end portions of each of the ridge members 44 and 48 adjacent the lower end 37 of the upper shank portion 34 is formed integrally with spacer legs 55.

With reference particularly to FIGS. 9 through 11, the female member 24 is formed as a tubular section 56 having an open upper end 58 and an open lower end 60. The tubular section 56 has a non-circular outer cross-section which may also be octagonal in cross-section, for example, and section 56 also has an axially extending circular bore 62. Upon or within two diametrically opposed wall members 64 and 66 of the tubular section 56, there are formed rectangularly-shaped windows 68.

The assembly of the male and female members 22, 24 of the bushing 14 of FIG. 1 into the fully assembled condition, as shown in FIGS. 12 and 13, will now be described. With the reduced shank portion 38 of the male member 22 being held over the circular bore 62 cf the tubular section 56 of the female member 24, the female member is pushed upwardly so as to telescopingly receive the disc-like member 52 into its circular bore 62. The diameter of the disc-like member 52 is slightly less than the diameter of the circular bore 62 of the tubular section. As the male and female members engage initially, the ridge members 44 and 48 of the reduced shank portion 38 will be contacting the interior surface of the bore 62. The diameter of the reduced shank portion 38 is somewhat less than the diameter of the bore 62 so that a plurality of equally-spaced, arcuate-shaped fluid passageways 72 are formed between adjacent ridge members 44, 48 as best seen in FIG. 13. It can be seen that each of the passageways 72 is also defined by means of a portion of the outer surface 39 of the reduced shank portion and a portion of the inner surface of the circular bore 62.

With the ridge members 44 being oppositely aligned with respect to the windows 68 and as the tubular section 56 is forced further upwardly so as to continue its advancement, the locking tabs 46 upon the ridge members 44 will snap into interlocking engagement with the opposed windows 68 so as to latch the male and female members together, thereby preventing withdrawal of the male member from the female member. It will be noted that the bump 50 upon each ridge member 48 contacts the inner surface of the bore 62 and has been dimensioned so as to provide a tight, snug fit with respect thereto. Furthermore, the plurality of spacer legs 55 will cause the lower end 37 of the upper shank portion 34 to be spaced apart from the open upper end 58 of the tubular section 56 so as to form a plurality of horizontally extending fluid passageways 70, as best seen in FIG. 12. The horizontal passageways 70 are in fluid communication with the respective arcuate-shaped passageways 72. As can be seen, the lower surface of disc-like member 52 is substantially flush with the lower open end 60 of the tubular section.

The assembled bushing 14 of the present invention can then now be installed into the top surface 12 of the refrigerator door 10, as shown in FIG. 14, prior to the injection of the foam insulation 20 into the door cavity 18. Referring back to FIG. 12, there is shown the paths in arrowed lines 74 which permit the relatively high pressurized air encountered during the foaming operation to escape from the door cavity 18 but yet restricts the escape of the foam insulation 20.

As can be seen, air within the door cavity 18 is allowed to pass through the respective horizontal passageways 70 and down the corresponding arcuate-shaped passageways 72 into the slots 54. The air from the plurality of slots 54 will be sent upwardly into the circular bore 40 of the reduced shank portion 38 which is in communication therewith and out the element-receiving bore 36 of the upper shank portion 34 to the central opening 32 defined within the head portion 26. In practice, it has been found that the foam insulation will not be able to travel past the circular bore 40 defined within the reduced shank portion. Thus, the foam insulation will not interfere with the element-receiving bore 36 defined within the upper shank portion 34 which will subsequently receive the hinge pin 16.

From the foregoing detailed description, it can thus be seen that the present invention provides an improved foam sealing bushing for use within a refrigeration door cavity. The bushing includes a male member, a female member for telescopingly receiving the male member, and passageways formed between the male and female members for permitting air to escape from the door cavity.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. A refrigeration, foam-sealing bushing for use within a refrigerator door cavity, comprising:

a male member including a head portion, an upper shank portion, a reduced lower shank portion, and a disc-like member;

said head portion being formed with an upper surface and a lower surface, and having a central opening defined therein;

said upper shank portion extending axially between an upper end adjacent to said lower surface of said head portion and a lower end, and having an element-receiving bore which is in communication with said central opening of said head portion;

said reduced lower shank portion extending axially between said lower end of said upper shank portion and an open lower end, and having a circular bore defined therein which is coaxially aligned for communication with said element-receiving bore of said upper shank portion;

said lower shank portion having a first pair of diametrically opposed ridge members formed upon its outer surface and extending axially from said lower end of said upper shank portion to its open end, each of said first ridge members having a locking tab;

said lower shank portion further including a second pair of diametrically opposed ridge members formed upon its outer surface and extending axially from said lower end of said upper shank portion to its open end, said second pair of ridge members being disposed within a plane which is perpendicular to a plane within which said first pair of ridge members is disposed;

spacer legs being formed integrally with portions of said first and second ridge members adjacent to said lower end of said upper shank portion;

said disc-like member being formed integrally with portions of said first and second ridge members adjacent to said open end of said lower shank portion so as to define a plurality of slots between said disc-like member and said lower shank portion;

a female member being formed of a tubular section having an open upper end and an open lower end, said tubular section having an axially extending bore extending between said open upper end and said open lower end for telescopically receiving said lower shank portion of said male member;

said tubular section having a pair of diametrically opposed windows for receiving said locking tabs of said first pair of ridge members of said male member so as to interlockingly engage said male and female members together; and passageway means formed between said outer surface of said reduced shank portion and the interior surface of said axially extending bore of said tubular section for allowing fluid communication with said element-receiving bore defined within said upper shank portion through means of said plurality of slots adjacent to said open end of said lower shank portion, whereby said passageway means permits air to escape from said door cavity but prevents foam insulation from escaping therefrom during injection of said foam insulation into said door cavity.

2. A bushing as claimed in claim 1, wherein said first and second ridge members are disposed around the outer surface of said lower shank portion at 90° intervals.

3. A bushing as claimed in claim 2, wherein said second pair of ridge members are formed with bumps for engaging the interior surface of the axially extending bore of said tubular section so as to provide a tight fit therewith.

4. A bushing as claimed in claim 1, wherein said upper shank portion has an outer cross-section which is octagonally-shaped.

5. A bushing as claimed in claim 4, wherein said tubular section has an outer cross-section which is octagonally-shaped.

6. A bushing as claimed in claim 1, wherein said male and female members are made from a resilient plastic material by an injection molding process.

7. A bushing as claimed in claim 1, wherein said passageway means are formed between adjacent spacer legs which separate the lower end of said upper shank portion from the open upper end of said tubular section and between adjacent first and second ridge members.

8. A bushing as claimed in claim 7, wherein the areas between said adjacent spacer legs form a plurality of equally-spaced horizontal passages.

9. A bushing as claimed in claim 8, wherein the areas between said adjacent first and second ridge members form a plurality of equally-spaced, arcuate-shaped passageways extending axially from said corresponding horizontal passages to said plurality of slots.

10. A refrigeration, foam sealing bushing for use in a refrigerator door cavity, said bushing comprising:

a male member including a head portion, an upper shank portion, a reduced lower shank portion, and a disc-like member;

said upper shank portion having its upper end connected to said head portion and its lower end connected to the upper end of said reduced lower shank portion, said disc-like member being connected to the lower end of said reduced lower shank portion;

a female member being formed of a tubular section having an open upper end and an open lower end, said tubular section having an axially extending bore extending between the open upper end and the open lower end for telescopingly receiving said lower shank portion of said male member;

means formed on said reduced lower shank portion and said tubular section for interlockingly engaging said male and female members together; and passageway means formed between the outer surface of said reduced lower shank portion and the inner surface of said axially extending bore of said tubular section for permitting air to escape from the door cavity but preventing foam insulation from escaping therefrom during injection of said foam insulation into door cavity.

11. A bushing as claimed in claim 10, wherein said upper shank portion has an outer cross-section which is octagonally-shaped.

12. A bushing as claimed in claim 11, wherein said tubular section has an outer cross-section which is octagonally-shaped.

13. A bushing as claimed in claim 10, wherein said male and female members are made from a resilient plastic material by an injection molding process.

14. A bushing as claimed in claim 10, wherein passageway means are formed by a plurality of equally-spaced spacer legs disposed be&ween the lower end of said upper shank portion and the open end of said tubular section.

15. A bushing as claimed in claim 14, wherein the areas between adjacent spacer legs form a plurality of equally-spaced horizontal passages.

16. A bushing as claimed in claim 15, wherein said passageway means are further formed by a plurality of equally-spaced ridge members disposed on the outer surface of said reduced lower shank portion.

17. A bushing as claimed in claim 16, wherein the areas between said ridge members form a plurality of equally-spaced, arcuate-shaped passageways extending axially between the corresponding horizontal passages and the lower end of said reduced lower shank portion.

18. A bushing as set forth in claim 10, further comprising:

a central opening defined within said head portion of said male member;

an axial bore defined within said upper shank portion of said male member for receiving a hinge-pin element of said refrigerator door;

an axial bore defined within said reduced lower shank portion of said male member and which is in fluidic communication with said axial bore of said upper shank portion;

spacer leg means defined upon said lower end of said upper shank portion of said male member for engaging said open upper end of said female member so as to space said lower end of said upper shank portion of said male member from said open upper end of said female member and thereby define spaces between said lower end of said upper shank portion of said male member and said open upper end of said female member which are in fluidic communication with said passageway means defined between said outer surface of said reduced lower shank portion of said male member and said inner surface of said tubular section female member; and slot means defined within said lower end of said reduced lower shank portion for fluidically interconnecting said passageway means and said axial bore defined within said reduced lower shank portion of said male member, whereby said air can escape from said door cavity through said spaces, said passageway means, said slot means, said axial bore defined within said reduced lower shank portion of said male member, said axial bore defined within said upper shank portion of said male member, past said hinge-pin element of said refrigerator door, and out said central opening of said head portion of said male member.

19. A bushing as set forth in claim 18, wherein:

said spacer leg means comprises four spacer legs equiangularly disposed about said lower end of said upper shank portion of said male member;

said passageway means comprises four passageways equiangularly disposed about said outer surface of said reduced lower shank portion; and said slot means comprises four slots equiangularly disposed about said lower end of said reduced lower shank portion.

20. A bushing as set forth in claim 10, wherein said interlockingly engaging means comprises:

a plurality of locking tabs integrally formed upon said reduced lower shank portion of said male member; and a plurality of window recesses formed within said tubular section of said female member for receiving said locking tabs of said male member.

* * * * *